US007582011B2

(12) United States Patent
Maling

(10) Patent No.: US 7,582,011 B2
(45) Date of Patent: Sep. 1, 2009

(54) MULTIPLE PLAYER PARTICIPATION GAME

(76) Inventor: Steven Maling, 3 Sonesta Ct., Landenberg, PA (US) 19350

( * ) Notice: Subject to any disclaimer, the term of this patent is extended or adjusted under 35 U.S.C. 154(b) by 0 days.

(21) Appl. No.: 11/831,145

(22) Filed: Jul. 31, 2007

(65) Prior Publication Data

US 2008/0036144 A1 Feb. 14, 2008

Related U.S. Application Data

(60) Provisional application No. 60/821,736, filed on Aug. 8, 2006.

(51) Int. Cl.
*A63F 13/00* (2006.01)

(52) U.S. Cl. ..... 463/16; 463/17; 463/22; 463/23; 273/138.1; 273/145 R; 273/146; 273/268

(58) Field of Classification Search ..... 463/16–23, 463/30–32; 273/138.1, 141 R, 142 R, 143 R, 273/142 B, 142 H, 142 HA, 145 R, 147, 273/146, 268

See application file for complete search history.

(56) References Cited

U.S. PATENT DOCUMENTS 3,642,286 A * 2/1972 Moore ..... 273/243
4,469,329 A * 9/1984 Guyer ..... 273/146
5,145,175 A * 9/1992 Gathman et al. ..... 273/146
5,263,715 A * 11/1993 Matsumoto et al. ..... 463/22
5,405,145 A * 4/1995 Jones et al. ..... 273/146
5,542,671 A * 8/1996 Stewart ..... 273/146
5,556,101 A * 9/1996 Jabro ..... 273/274
5,573,248 A * 11/1996 Parra et al. ..... 273/274
5,662,330 A * 9/1997 Spears ..... 273/274
5,676,375 A * 10/1997 Pirouzkhah ..... 273/274
6,120,377 A * 9/2000 McGinnis et al. ..... 463/20
6,257,580 B1 * 7/2001 Brown ..... 273/274
6,299,166 B1 * 10/2001 Factor ..... 273/146
6,422,563 B1 * 7/2002 Fairchild et al. ..... 273/274
6,565,088 B2 * 5/2003 Perrie et al. ..... 273/146
6,601,848 B1 * 8/2003 Timmons, Sr. ..... 273/146
6,605,001 B1 * 8/2003 Tarantino ..... 463/22
6,729,619 B2 * 5/2004 Yu et al. ..... 273/146
6,761,353 B2 * 7/2004 Berman et al. ..... 273/143 R
7,185,889 B2 * 3/2007 VanZanten ..... 273/146
7,401,781 B2 * 7/2008 Guyer et al. ..... 273/146

(Continued)

OTHER PUBLICATIONS

Winning Moves, "Winning Moves Games—Classic, Retro, Cool & Fun!," 2007, Winning Moves, http://www.winning-moves.com, 1.*
Wikipedia, "Yahtzee—Wikipedia, the free encyclopedia," 2007, Wikipedia, http://en.wikipedia.org/wiki/Yahtzee, 1-9.*
The Free Dictionary, "Yahtzee—encyclopedia article about Yahtzee," 2007, The Free Dictionary, http://encyclopedia.thefreedictionary.com/Yahtzee, 1-8.*

*Primary Examiner*—Peter DungBa Vo
*Assistant Examiner*—Arthur O. Hall
(74) *Attorney, Agent, or Firm*—Connolly Bove Lodge & Hutz

(57) ABSTRACT

A multiple player participation game utilizes a multi-sided tray which comprises a pit surrounded by a multi-sided frame. The upper edge of each side of the frame has a set of pockets corresponding to a set of dice for each player. A multi-sided challenge cube is used which has game instruction indicia on each of its sides determining how the game is played for that hand. Each player shakes the player's dice in a shaker cup. During the course of the game players forfeit one or more dice which are then placed in the corresponding pockets of the tray.

12 Claims, 2 Drawing Sheets

U.S. PATENT DOCUMENTS

Figure 1:
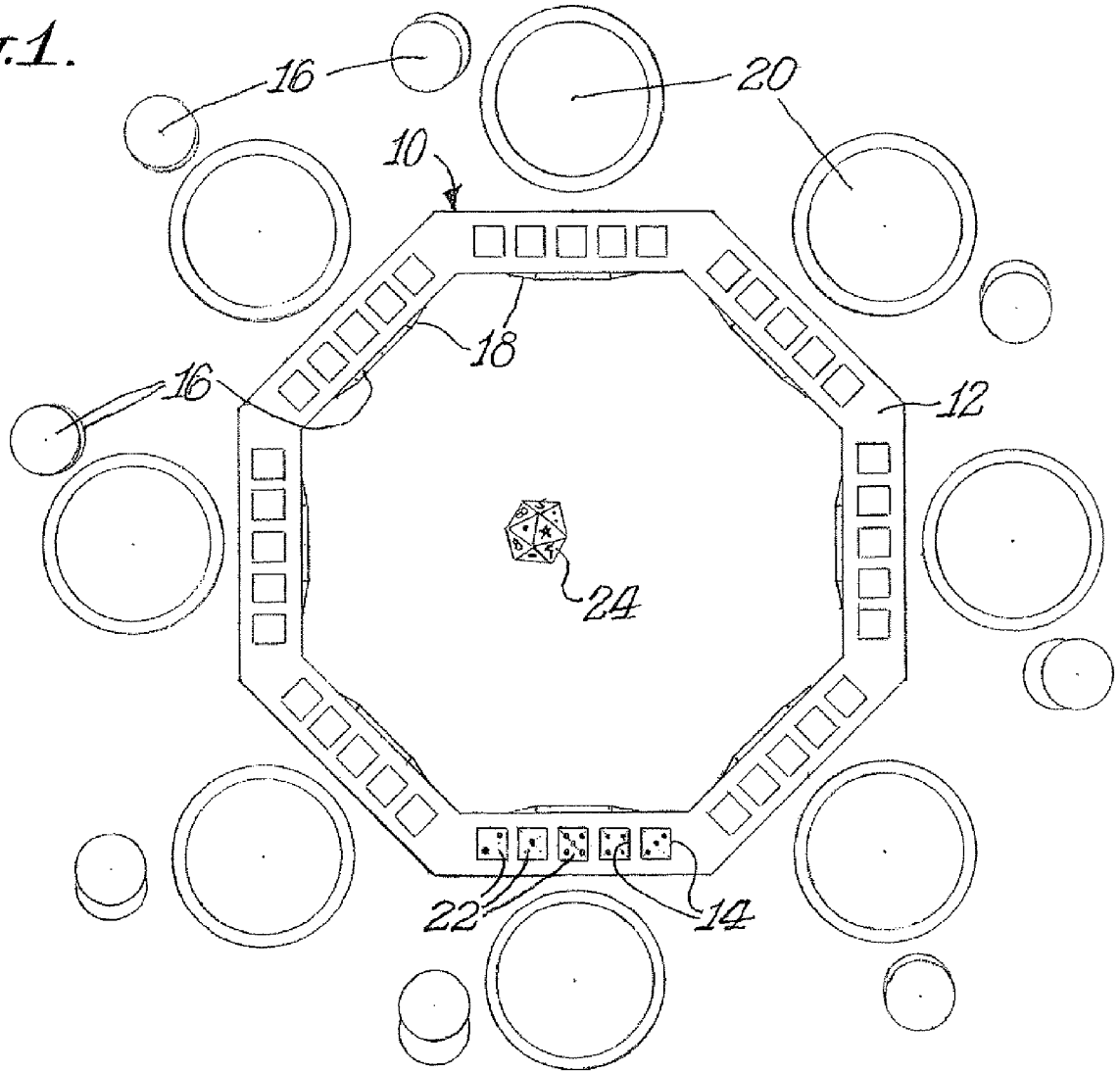

| | | | | |
|---|---|---|---|---|
| 7,527,265 | B1 * | 5/2009 | Berman | 273/274 |
| 2002/0117801 | A1 * | 8/2002 | Kennedy | 273/146 |
| 2004/0009803 | A1 * | 1/2004 | Bennett et al. | 463/16 |
| 2004/0033831 | A1 * | 2/2004 | Tarantino | 463/22 |
| 2004/0152498 | A1 * | 8/2004 | Kaminkow et al. | 463/16 |

* cited by examiner

MULTIPLE PLAYER PARTICIPATION GAME

CROSS-REFERENCE TO RELATED APPLICATION

This application is based upon provisional application Ser. No. 60/821,736 filed Aug. 8, 2006, all of the details of which are incorporated herein by reference thereto.

BACKGROUND OF THE INVENTION

Various types of games are available which involve multiple players. One known game is Liar's Dice which is based on draw poker. The object of the game is to call an opponents bluff or to convince the opponent to challenge honest calls. In one version of the game two to four players are provided with an opaque dice cup, 10 poker chips or other betting counters and five dice. Each player rolls one die. The highest roller goes first and the play proceeds, for example, to the left or clockwise. A round of play begins with the first player (the caller) shaking five dice in the cup and turning the cup upside down on the table. The caller peeks at his/her dice keeping the results hidden from other players. The caller then decides whether to stand pat or draw. If the caller chooses to draw there would be a re-roll of any number of dice. Such re-roll would be permitted twice in one turn. The caller then announces his/her hand by stating something specific such as "I have three fours". The hands are ranked in the following order: five of a kind; four of a kind; full house; high straight; low straight; three of a kind; two pair; and one pair. Play continues by moving to the next player who may challenge the caller's statement or the player may roll his/her dice and make a call on the player's own hand. To make a call the hand must be higher than the original caller's hand. The person to this new caller's left may now challenge, or roll and make his/her own call. The dice are revealed when a player is challenged. If the challenger is wrong and the caller was honest about his/her hand, the challenger must put a counter into the pot. If the caller is caught bluffing the caller must put a counter into the pot. A new round is begun each time a challenge is made. The game is won when only one participant remains who has a counter.

There are other variations of Liar's Dice based upon the above general rules.

Various other games exist using dice and other objects such as in game boards. One game marketed under the name, Gamestation utilizes a hexagonal tray as a pit for the dice.

SUMMARY OF THE INVENTION

An object of this invention is to provide a multiple player participation game which is a variation of Liar's Dice.

In accordance with this invention the multiple player participation game includes a multi-sided, preferably octagonal tray wherein each side includes a single or divided pocket for receiving the individual dice and a compartment for holding chips or counters. In addition to each player having a set of dice, there is a single challenge cube which affects how the game is played. Preferably, the sets of dice are color coded. Each player is also provided with a cup or shaker for the dice.

THE DRAWINGS

Figure 2:
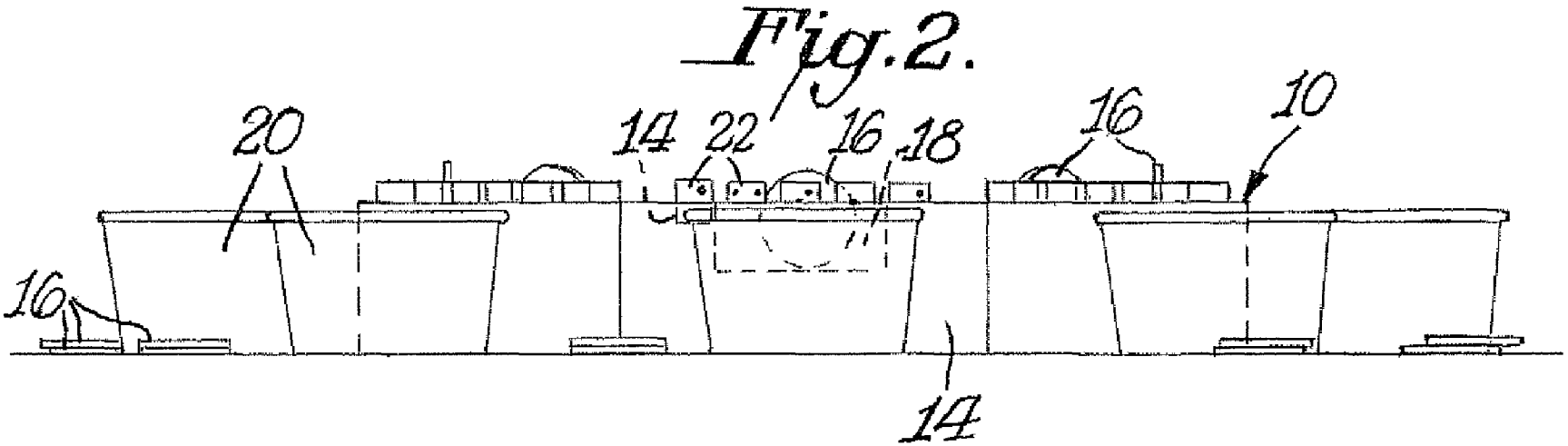

FIG. 1 is a top plan view showing the various articles used in the playing of a multiple player participation game in accordance with this invention; and FIG. 2 is a side elevational view of FIG. 1.

DETAILED DESCRIPTION

FIGS. 1-2 illustrate the physical articles which would be used in the playing of a multiple player participation game in accordance with this invention. As shown therein, one of the articles is a multi-sided tray 10. In the preferred practice of this invention there would be anywhere from three to eight players who can play at a time. To accommodate all of these players tray 10 is preferably of octagonal shape so that each player would be assigned one side of the upstanding frame 12 which surrounds the perimeter of tray 10. As a result a pit is formed within the frame. Each side of frame 12 is of sufficient height and width that it includes a series of pockets 14 whereby a single die may be placed in each pocket. The invention may be broadly practiced where a single pocket may hold all of the dice of each set, rather than the preferred practice where pocket 14 is divided into a series of pockets each of which would hold a die.

Tray 10 also includes structure for holding chips or counters 16. Such structure is preferably an elastic pocket 18 which in the preferred practice of the invention is located on the inner side of each wall. If desired, however, the pocket or chip container can be at any other location such as the outer side of the wall or in the broad practice of the invention the chips could simply be held loose or in any other separate container.

Although FIG. 1 illustrates the tray 10 to be of octagonal shape with an octagonal pit in the center other shapes could be used. For example, the tray could be a square shape having an octagonal pit in the center and the chips 16 could be stored in the available corners.

Each player is also provided with a shaker 20 which could be a tapered opaque cup having its large diameter at its upper open end and the small diameter at its lower closed end. Each player would also be provided with a set of dice 22. Preferably, there are five dice in each set. The final article is a challenge cube 24 which affects how the game is played.

The pit and the cups or shakers 20 could be felt lined to keep down the noise of the game.

The following is an example of a preferred manner of playing the game. As indicated, preferably anywhere from 3 to 8 players can play at a time. In its broad aspect there could be more than 8 players or possibly even only 2 players. The game is intended to flow quickly and utilize strategy, deception and luck in each hand. Preferably, the game would be ideal for players at least 9 years old.

The game would be played in a number of rounds, preferably up to three rounds. Each player would start a round with an equal number of dice, such as the five dice illustrated. A round of play is made up of multiple hands. For each hand played one player will loose one or possibly two dice. The round continues until one person is left with at least one die. That person wins the round and receives the pot of betting chips 16.

When the game is played the tray 10 or pit would be placed in the center of the playing surface. Each player would be issued or buys, for example, three betting chips 20 for each round of play. The betting chips could be of any color and preferably would be white. Alternatively, the chips may contain a color corresponding to the color designation of the dice. Following the color theme, each set of dice would be color coded in that all five dice of a set would be of a color different from the five dice of every other set.

At the start of a round of play each player will shake his/her dice in the shaker cup 20 and then turn the cup over onto the playing surface. All players would show their hands and the highest hand would have the honors of starting. During this "pittle" which is used to determine the start, the ones on the dice are not wild. In determining who will start the round of play different guidelines could be used such as the total of the numbers of the five sets of dice for each player. The players would ante-up by placing one chip into the pocket 18 in front of the side allocated to that player with a color corresponding to the player's dice color. Similarly, each shaker cup 20 might also be completely or at least partially contain a color corresponding to the dice color of each player.

The game will now begin with the starting player rolling the challenge cube 24. After each hand the player who loses a die will be the player to roll the challenge cube 24 before the next hand is played. [A variation of this procedure is later described with regard to a cross-rip feature.] The following list exemplifies how it is determined that a hand will be played based upon indicator information on the challenge cube. Preferably, the challenge cube has at least 8 sides and most preferably 20 sides. One or more of each side would contain a type of game instruction indicia or indicator information. For example, a single dot might be used to indicate that the hand is being played for a single die to be forfeited by the loser of the hand;

two dots would indicate that two dice would be forfeited by the loser of the hand;

the letter "R" might indicate that there should be reverse or change in the direction of play rotation for only that hand. The loser of the hand would forfeit a single die;

the letters "CR" refer to a cross-rip which allows anyone to challenge another player at any time during the play of the hand by making an announcement such as "I am cross-ripping on that call". The person to the left of the challenged player will lift the first cup to start the count. The loser of the hand will forfeit a single die. The person who "wins" the call will control the challenge cube and will also make the initial bet for the next hand.

A symbol such as the number 1 with a line drawn through it might be used to mean that ones are not wild for this hand only. All players should exercise caution when making their call as the odds in the hand will change. The loser of the hand will forfeit a single die.

The letters "NL" refer to a "no look" hand which means that all of the players must not look at their dice under their cup once the cup has been placed up-side down onto the playing surface. This is a completely blind betting hand. The loser of the hand will forfeit a single die.

A star would mean that all players share an extra wild (an extra "1") in the play that gets counted for the hand. Again, players should realize that the odds will change for this hand. The loser of the hand will forfeit a single die.

Letters such as "DD" might be used to mean that all players must immediately sacrifice a die for this hand, except for the player that rolled the challenge cube. Rolling the DD could force players from the round. The same player who rolled the "DD" will roll the challenge cube again to set the hand.

To continue play each player places his/her dice 22 into the player's shaker cup 20 and the players mix their dice. When ready each player will turn the shaker cup over onto the playing surface leaving the cup over top of the dice thus concealing the dice. A player may not reshake his/her dice once the player has looked under his/her cup. If, however, a player has stacked dice under the cup the player must announce something similar to "I'm stacked" and lift the cup to show the other players. Only the player with the stacked dice gets to reshake his/her dice for the hand.

Once all cups are down each player may look at his/her hand by tipping the shaker cup 20 up on edge and keeping their hands cupped around the shaker cup. This would assure the dice being hidden from other players.

A key strategic factor to the game is that ones are always wild (except when the no wild symbol has been rolled for that hand). For example, if there are six players with five dice there would be 30 dice in play. Generally, a player is at the cusp when the player makes a call which is ⅓ or higher than the total number of dice in play. In this example a call of "11 fives" may be at risk. In that regard, when making the call players should realize that an estimate is being made of the total number that has been called (e.g. fives) plus all the wild ones that will be under the cups. But what is under the other cups will not be known until a challenge is made.

There may be two options available to each player making his/her call, either to tell the truth or to lie. For an example, if a first player makes the call of "8 fives" the player may or may not have any fives or any ones at all. The next player must either challenge that person's hand or increase the call by stating, for example, "8 sixes" or "9 threes" or "9 fives". The call can be any combination as long as the total dice value increases. This would be an increase in dice value, for example, "8 fives" increase to "8 sixes" or increasing the value and/or quantity to "9 threes" or "9 fives".

When a player believes that the previous player has made a call (such as "13 threes") that will not be supported by all the ones and threes under the cups 20, then a challenge is made, such as by announcing "I'll call". Starting with the player that has made the challenge the shaker cups 20 are then lifted one by one revealing each player's dice and a running count of the call number is made which will include the wild ones. The player that has been challenged will lift his/her cup last.

As each cup 20 is lifted the ones and threes in this example will be counted. If there are 13 or more threes and ones added together, then the challenge failed and the challenger loses one die (or two dice). This "lost" die gets placed into the die holder or pocket 14 on the corresponding color code on the sides of frame 12 on the top edge of the pit or tray 10. If there are less than the 13 threes that were called then the player that announced "13 threes" will lose one die (or two dice). As the count comes around the table, if a player that has been challenged knows that he/she lost the hand, that player does not have to show his/her hand, but that player must forfeit a die (or two) depending on what the challenge cube 24 had dictated.

A change in the game format occurs if there are only two or more players left and each person has only a single die then everyone still in play must make a call based on the total number of dots the player believes will be shown when the cups are lifted. Ones are not wild at this point. For example, the first player might have four dots showing under his/her cup and the player may call "three dots". The next player must either challenge or call a higher number of dots. In an example, player 2 (having a six under the cup) might call "7 dots" then the decision is back to player 1. Of course, neither player knows that there might actually be a total of nine dots. Again play will continue until a player challenges the other. The dots showing will be counted to determine the winner.

The player that has dice remaining wins the round and will collect a betting chip 16 from each player. The first player out of the first round of play will start round 2 by rolling the challenge cube 24 and making the first call.

Preferably, a game consists of three rounds of play, although in its broad practice more or less than three rounds may be played. The overall game winner is the player that has collected the most betting chips over the three rounds. A new game begins upon redistribution of betting chips.

When playing the last round of the last game the number of betting chips, such as two betting chips could be used to increase the stakes.

Based upon the prior description, the game may be played in the following manner. Where used with eight players the game equipment would include forty dice that are divided into sets of different colors of five dice in each set, such as five red dice, five blue dice, etc. The pit created by the tray 10 having its surrounding multi-sided frame 12 is used to roll the challenge cube 24 and to hold the lost dice 22 along the top edge. Showing the lost dice is important when determining the cusp number. By color coding the dice that each player is issued at the start of play, a competitor can also determine how many dice are left in each player's hand. In this embodiment there would be 8 shaker cups 20 which preferably are color coded to the same color as the corresponding set of dice 22. Each player would be given or buys, for example, three white betting chips 16. A betting chip 16 would be anted by placing the chip into a pocket 18 inside the pit located on a corresponding side of the frame 12. This readily makes apparent how many chips 16 are in for a round. The twenty sided challenge cube 24 would be rolled prior to each hand and would dictate the manner of play for that hand or it might affect the stakes for that hand which is whether a player loses one or two (or even more) dice.

In general, each player shakes his/her dice 22 in the shaker cup 20 and keeps the dice 22 hidden from the opponent. Ones are always wild unless the challenge cube 24 is rolled with its indicia indicating that ones would not be wild for a particular hand. Each player takes a turn making a call. Each call must be of increasing value based upon the belief that the hidden dice, once revealed, will cumulatively tally the call number of twos through sixes plus all the wild ones. When a player believes there is not a total number of dice called plus the wild ones, there will be a challenge. The cups 20 are lifted one at a time and the dice are tallied. If the caller is covered by the number called then the challenger loses at least one die depending on whether the challenge cube called for losing more than one die. Conversely, if the challenger is correct that the number of dice called is not under the shakers then the caller must forfeit at least one die. The play continues until there is a single player left with at least one die. If the game comes to a point where each player is left with a single die, then the game format switches to calling the dots shown in the respective die until a player makes a challenge.

The game could be an electronic game, for example, offered as a computer game with www.access, as a game for a gaming console (e.g. Playstation), as a hand held electronic game, as an in-line electronic casino game, as a virtual digital casino table game or as an onsite table casino game. Where used as a casino game the casino could substitute its own logo onto the challenge cube in place of, for example, "DD". This would also designate that the house is taking a die from each player. Between the DD and the "2 dots" featured on the challenge cube the play quickens to benefit the house. The house could alter the statistical probability and odds by changing the quantity of the two dots and the DD markings versus other cube options.

In one aspect of this invention the game could be used as part of a tournament which could be televised or otherwise viewed by live audiences. While the game has been described with respect to specific components, variations would be made where, for example, the game is being used as a computer game or handheld electronic game.

In the preferred practice of the invention, using a home board game, the tray or pit 10 is sufficiently large to accommodate the dice 22 and chips 16 and to act as a pit for rolling the challenge cube 24. The tray 10 should, however, be small enough to be placed on a table or other surface. The same game board could be used to play different game variations where new game pieces are introduced.

It is to be understood that the above description pertains to a preferred manner of playing the multiple player participation game. Other variations would be possible within the concepts of this invention.

What is claimed is:

1. A multiple player participation game comprising:

a plurality of game components including a plurality of betting counters, a multi-sided tray, a frame around said multi-sided tray, said frame having an upper edge, at least one downwardly extending pocket in said upper edge at each of said sides of said frame, a plurality of sets of dice to correspond to a plurality of players, each player having a separate set of dice, wherein said plurality of sets of dice include a first portion that may become forfeited during the course of game play and a second portion that are remaining after said first portion are forfeited so as to be used during the course of game play, and a shaker for each of said plurality of sets of dice to permit a each of the plurality of players to create a hand by shaking said plurality of sets of dice in said shaker and then dispensing said plurality of sets of dice from said shaker, wherein each of said plurality of sets of dice have said first portion selectively positioned in a side by side relationship in said at least one pocket in each of said sides, and wherein said second portion are selectively disposed in said shaker when the hand is being created and said first portion are disposed in said at least one pocket during a period of time when said dice are forfeited, and a multi-sided challenge cube having game instruction indicia on each of its sides corresponding to variations in rules of how the game is played, which is used with the plurality of game components, wherein each of the plurality of players shake said second portion in said shaker to create a hand, and wherein the rules of the game are determined by said challenge cube which is rolled on said tray, and wherein said first portion which are forfeited are stored in said at least one pocket, and wherein the winner of a hand wins said betting counters.

2. The game of claim 1 wherein each of said sides of said frame has a receptacle for receiving said counters.

3. The game of claim 2 wherein said sets of dice and said shakers are color coded with the color of each set differing for the other sets.

4. The game of claim 3 wherein said at least one pocket on each of said sides comprises a plurality of individual pockets corresponding to the number of said dice in each of said sets.

5. The game of claim 4 wherein the central portion of said tray within said frame comprises a pit onto which said challenge cube may be rolled, said pit and said shakers being felt lined to minimize noise, said betting counters being chips, and each of said receptacles being a pocket on the inner surface of each of said sides.

6. The game of claim 5 wherein said multi-sided tray has eight sides.

7. The game of claim 5 wherein said challenge cube is 20 sided.

8. The game of claim 1 wherein said sets of dice are color coded with the color of each set differing for the other sets, and wherein each of said shakers is color coded to correspond to the color of its set of dice.

9. The game of claim 1 wherein said at least one pocket on each of said sides comprises a plurality of individual pockets corresponding to the number of said dice in each of said sets.

10. The game of claim 1 wherein the central portion of said tray within said frame comprises a pit onto which said challenge cube may be rolled.

11. The game of claim 1 wherein said betting counters are chips, and each of said receptacles being a pocket on the inner surface of each of said sides.

12. The game of claim 1 wherein said game instruction indicia includes variations for each hand, and said variations being selected from the group consisting of how many dice are forfeited and/or how that hand is played, and which dice are not wild.

* * * * *